US005487444A

United States Patent [19]

Dennington

[11] Patent Number: 5,487,444

[45] Date of Patent: Jan. 30, 1996

[54] SHOCK-ABSORBING SAFETY HARNESS

[76] Inventor: Mark Dennington, P.O. Box 2447, Kenai, Ak. 99611-2447

[21] Appl. No.: 35,459

[22] Filed: Mar. 23, 1993

[51] Int. Cl.[6] ..... A62B 35/00

[52] U.S. Cl. ..... 182/6; 244/151 R

[58] Field of Search ..... 182/3–7; 244/151 R; 482/43

[56] References Cited

U.S. PATENT DOCUMENTS

| | | | |
|---|---|---|---|
| 1,967,767 | 7/1934 | Diez | 182/3 |
| 2,422,440 | 6/1947 | Severance | 244/151 R X |
| 2,987,279 | 6/1961 | Gray | 244/151 R |
| 3,379,439 | 4/1968 | Sorenson | 182/3 X |
| 3,424,134 | 1/1969 | Rosenblum | 119/96 |
| 4,618,026 | 10/1986 | Olsen | 244/151 R |
| 5,080,191 | 1/1992 | Sanchez | 182/3 |
| 5,178,590 | 1/1993 | Stephens | 482/43 |
| 5,220,976 | 6/1993 | Gunter | 182/3 |

FOREIGN PATENT DOCUMENTS

| | | | |
|---|---|---|---|
| 553653 | 10/1926 | France | 244/151 R |
| 649884 | 12/1928 | France | 244/151 R |
| 3216599 | 11/1983 | Germany | 182/3 |
| 243814 | 3/1987 | Germany | 182/3 |
| 7413214 | 1/1975 | Netherlands | 182/3 |
| 13115 | of 1893 | United Kingdom | 182/11 |

*Primary Examiner*—Alvin C. Chin-Shue
*Attorney, Agent, or Firm*—Christensen, O'Connor, Johnson & Kindness

[57] ABSTRACT

A safety harness assembly (10) includes a harness (12) securable to a person's torso having an anterior side (14) and a posterior side (16). A resilient, elastomeric cord assembly (18) has an anterior end portion (24) connected to the anterior side of the harness, and a posterior end portion (26) connected to the posterior side of the harness. An intermediate portion (28) of the elastomeric cord assembly is connectable to a safety lanyard (22). The safety harness assembly absorbs shock and positions the person upright when worn to support a person's weight and break the impact of falls.

13 Claims, 4 Drawing Sheets

Fig. 3.
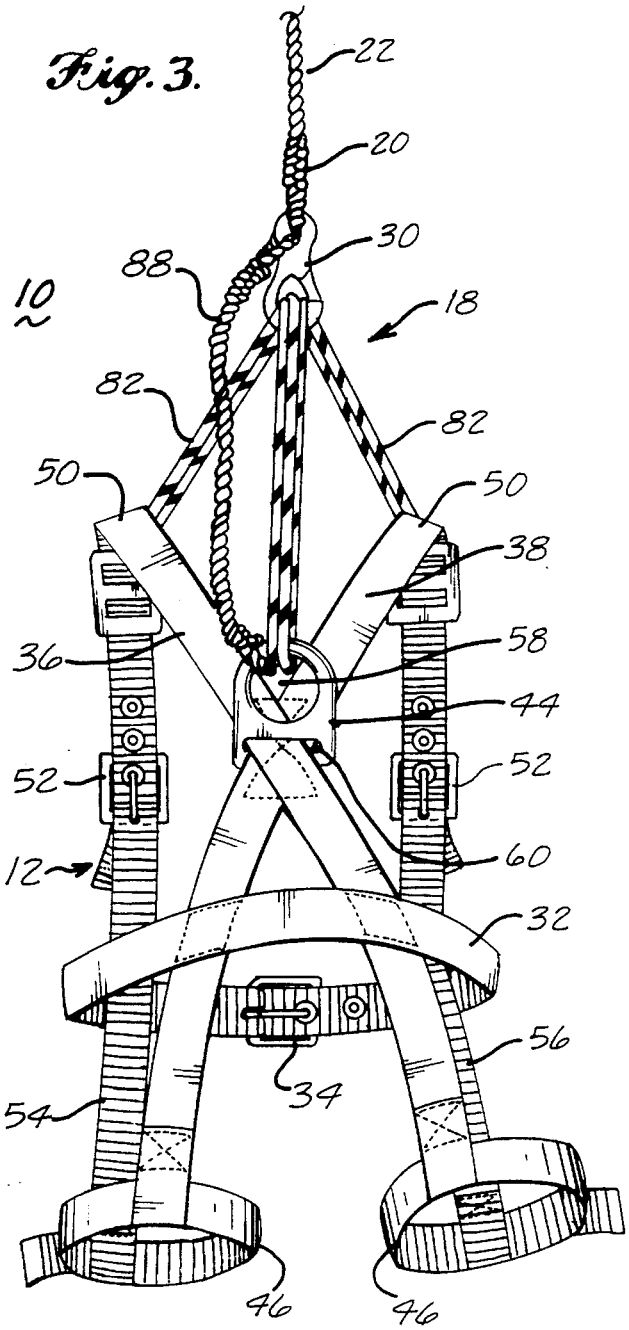
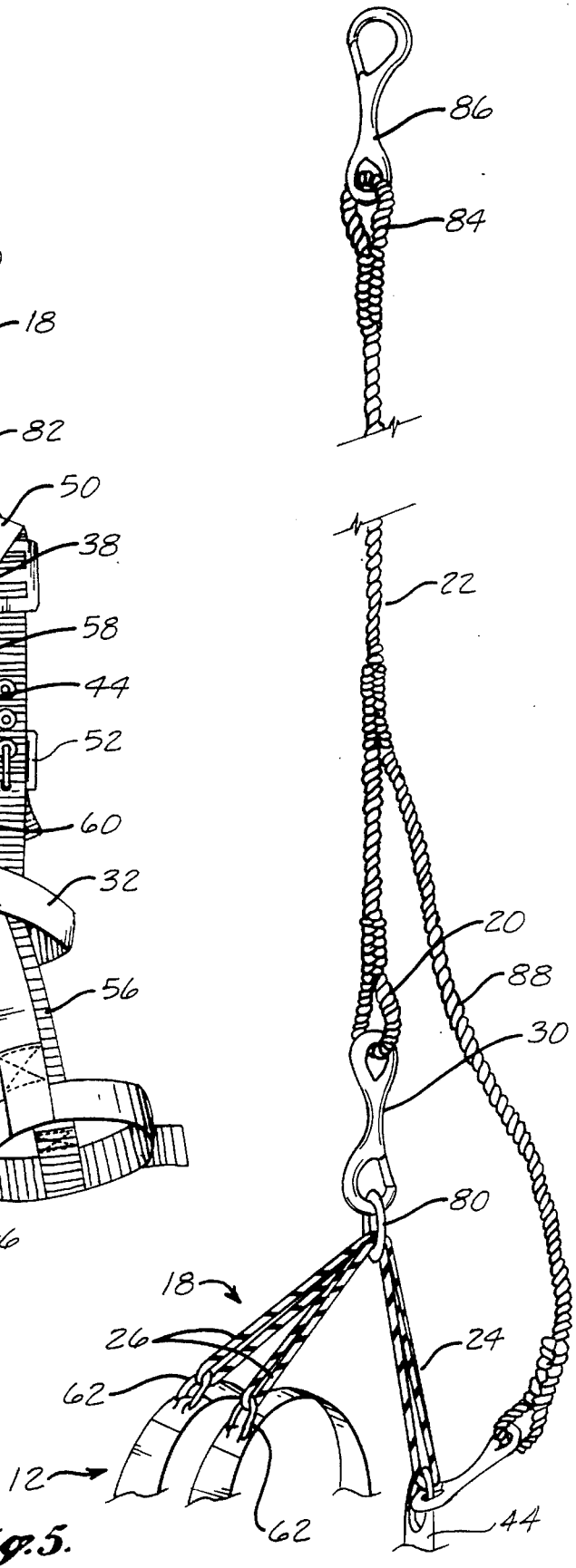
Fig. 5.

SHOCK-ABSORBING SAFETY HARNESS

FIELD OF THE INVENTION

The present invention relates to safety harnesses used to protect people from injury upon falling from elevated structures.

BACKGROUND OF THE INVENTION

Workers employed for new construction of elevated structures, such as buildings, scaffolding, marine oil rigs, and elevated pipelines, are often required to wear a safety harness connected to one end of a lanyard, with the other end of the lanyard being secured to the structure on which the worker is employed. The harness and lanyard support the worker's weight should the worker accidentally fall, breaking the fall and thereby preventing the worker from impacting the ground. Safety harnesses and lanyards are also advisable for people performing other tasks or activities at high elevation, such as window washers and recreational climbers.

Conventional safety harnesses are constructed from sturdy material such as nylon webbing or leather. The harness typically includes a "D"-ring or other fitting secured to the harness to which a coupling on the end of the safety lanyard can be connected. The safety lanyard is typically constructed from a line that is not capable of substantial reversible elongation, such as a nylon rope. Such lanyards and harnesses are capable of supporting a person upon falling, but do not do an effective job of protecting the person from many injuries. Because of the non-resilient nature of the harness and lanyard, the person is subjected to severe impact when the lanyard is initially pulled taut. Additionally, because most lanyards are connected to the posterior side of the harness, i.e., to the back of a worker, the worker is often supported in a face-down (prone) position upon falling. This causes the worker's head to project forwardly, which may expose the worker's head to impact with a building or other structure on which the worker is employed. Thus, while the worker may not strike the ground, the shock of the terminated fall and impact with the elevated structure may potentially still result in substantial trauma to the head and spinal column.

Climbers typically utilize a climbing rope that is designed to undergo a limited extent of deformation to absorb impact upon a climber's fall. This deformation is not completely reversible, due to the rope strands being stressed near their elastic limit of elongation, and the rope is traditionally discarded after it has been used to stop a climber's fall. Additionally, the amount of shock absorption provided by elongation of the rope is very limited, particularly if the rope is not extremely long. Further, such harnesses again typically place the user in a prone position upon falling, rendering the user susceptible to head and spinal cord trauma.

SUMMARY OF THE INVENTION

The present invention provides a safety harness assembly including a harness that is securable to a person's torso and a resilient member connected to the harness. The resilient member is connectable to a safety lanyard, whereby the lanyard and harness are capable of supporting the person's weight and the resilient member is reversibly deformable to absorb impact loads imposed on the lanyard and harness.

In a preferred embodiment, the resilient member has a first end connected to the harness proximate an anterior side of the harness, and a second end connected to a posterior side of the harness. An intermediate portion of the resilient member disposed between the first and second ends is constructed and configured to be connectable to a safety lanyard. This configuration and connection of the resilient member causes the person wearing the harness to be positioned in an upright disposition when the harness and lanyard support the person's weight.

The present invention thus provides a safety harness that absorbs impact loads when the harness and lanyard catch a user during a fall. The resilient member reversibly deforms to absorb significant shock, thereby cushioning the user's fall and protecting him or her from injury associated with the impact. Additionally, because of the upright positioning of the person, head and spinal cord trauma associated with prone (face-down) positioning of the user is reduced.

BRIEF DESCRIPTION OF THE DRAWINGS

The foregoing aspects and many of the attendant advantages of the present invention will become more readily appreciated as the same becomes better understood by reference to the following detailed description, when taken in conjunction with the accompanying drawings, wherein:

FIGS. 1, 2 and 3 are pictorial isometric, front, and back views, respectively, of a first embodiment of a safety harness constructed in accordance with the present invention, with the fail-safe lanyard not being shown in FIG. 2 for clarity;

FIG. 5 presents a pictorial, side elevation view of a safety lanyard coupled to the safety harness of FIG. 1, with the lower portion of the safety harness shown broken away, and utilizing an alternate splicing of the fail-safe lanyard to the safety lanyard.

DETAILED DESCRIPTION OF THE PREFERRED EMBODIMENT

Figure 1:
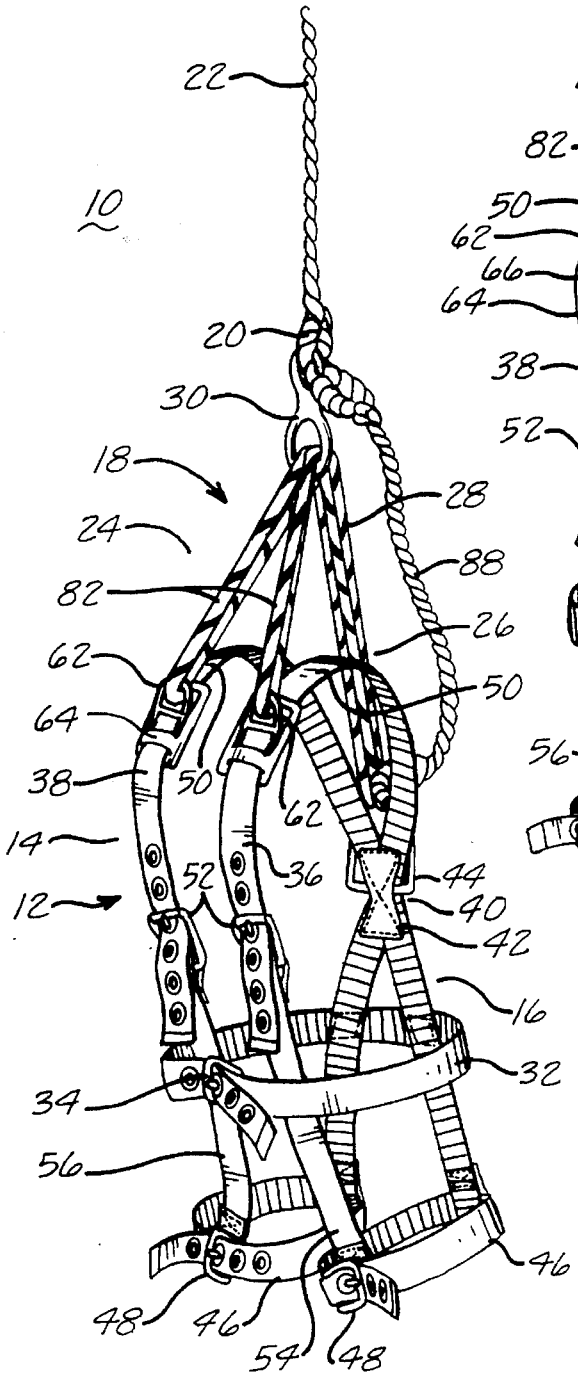
Figure 2:
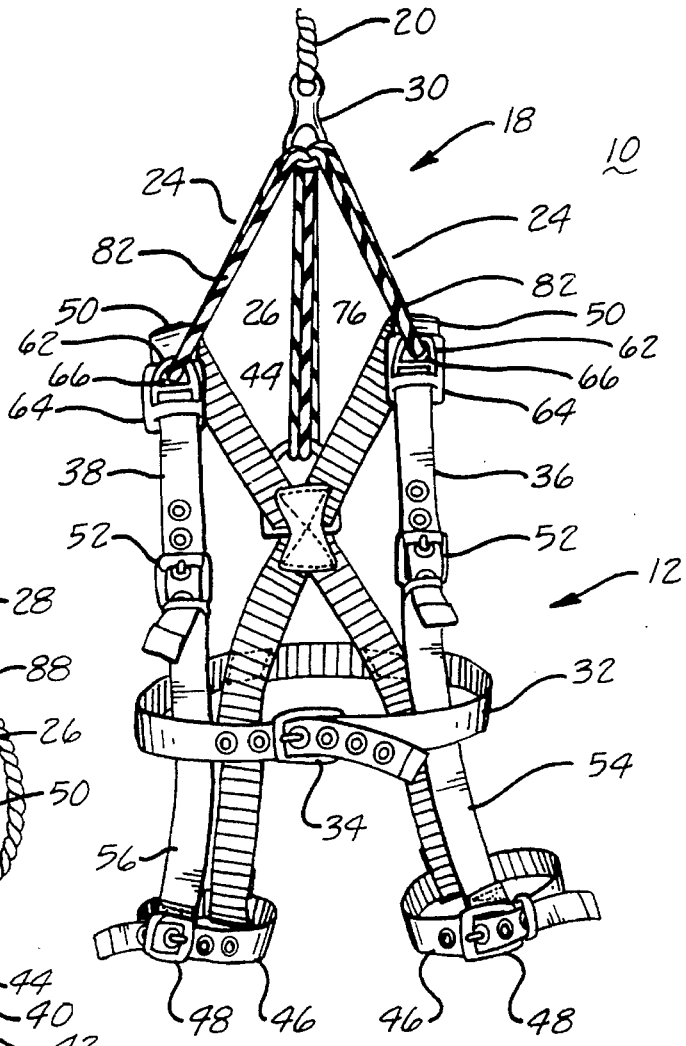

A safety harness assembly 10 constructed in accordance with the present invention is shown in FIGS. 1 through 3. The safety harness assembly 10 includes a harness 12 securable to a person's torso, and having an anterior side 14 and a posterior side 16. As used herein throughout, anterior refers to the portion of the harness intended to contact the from side of a person, i.e., the chest side, while posterior refers to the rear or back side thereof. The safety harness assembly 10 further includes a resilient, elastomeric cord assembly 18 that connects the harness to a first end 20 of a safety lanyard 22. The elastomeric cord assembly 18 has an anterior end portion 24 connected to the anterior side 14 of the harness 12 and a posterior end portion 26 connected to the posterior side 16 of the harness 12. An intermediate portion 28 of the elastomeric cord assembly 18 disposed between the anterior end portion 24 and the posterior end portion 26 is received within a lanyard snap hook 30 secured to the first end 20 of the safety lanyard 22.

The harness 12 shown in FIGS. 1 through 3 is of conventional construction, except as modified in accordance with the present invention for connection to the elastomeric cord assembly 18. The harness assembly 12 may be constructed from leather, nylon webbing, or other strong, flexible material. The harness 12 includes a belt 32 that encircles a person's waist. The ends of the belt 32 are coupled by a belt buckle 34 on the anterior side 14 of the harness 12. The belt buckle 34 is adjustable to size the belt 32 to fit a particular wearer.

The harness 12 further includes a left shoulder strap 36 and a tight shoulder strap 38. The left and right shoulder straps 36 and 38 are crossed over at a junction 40 on the posterior side 16 of the harness 12. The junction 40 is stitched together, and reinforced by a patch 42 that is sewn in place to secure a posterior D-ring 44 to the posterior side 16 of the harness 12. The D-ring 44 is thus centered on the posterior side 16, approximately midway between the highest point of the shoulder straps 36 and 38 and the belt 32. Below the junction 40, each of the shoulder straps 36 and 38 passes inside and is sewn or otherwise secured to the posterior side of the belt 32.

The shoulder straps 36 and 38 extend downwardly below the belt 32. A belted thigh cuff 46 is secured to the end of each of the shoulder straps 36 and 38 below the posterior side of the belt 32. Each thigh cuff 46 includes on its anterior side a thigh buckle 48, and can be adjustable secured around a wearer's thighs.

Above the junction 40, each of the left and right shoulder straps 36 and 38 extends upwardly and then folds back downwardly toward the anterior side 14, defining at the apex a shoulder portion 50. Each shoulder strap 36 and 38 then continues down the anterior side 14 where it is connected to the chest buckle 52 of a corresponding left or right extension strap 54 or 56, respectively. Each of the left and right extension straps 54 and 56 depends downwardly from the anterior side of the corresponding left or fight shoulder strap 36 or 38, passing inside and being secured to the belt 32 on either side of the belt buckle 34. The lower end of each of the extension straps 54 and 56 is secured to a corresponding thigh cuff 46 adjacent one side of the thigh buckle 48.

The harness 12 thus completely secures a person when worn by a person with the chest buckles 52 being connected to secure the shoulder straps 36 and 38 over the shoulders, the belt 32 being secured around the waist by the belt buckle 34, and the thigh cuffs 46 being secured by thigh buckles 48. This conventionally constructed harness 12 typically includes the posterior D-ring 44. Referring to FIG. 3, the posterior D-ring 44 includes a central aperture 58 and a slot 60 through which the shoulder straps 36 and 38 are threaded. The patch 42 is sewn onto the inside of the junction 40 to secure the posterior D-ring 44 in place. For conventional safety harnesses, a safety lanyard would be connected directly to the posterior D-ring 44.

However, the otherwise conventionally constructed harness 12 is modified to produce the safety harness assembly 10 of the present invention. An anterior D-ring 62 is secured to each of the left shoulder strap 36 and right shoulder strap 38, as shown in FIGS. 1 and 2. The anterior D-rings 62 are preferably secured to the anterior side of the shoulder straps 36 and 38, immediately below the shoulder portion 50 of each shoulder strap. Each anterior D-ring 62 is secured in place by a patch 64. The patch 64 can be constructed from leather, nylon webbing, or other suitably strong material. The patch includes four transverse, spaced-apart slots. To install an anterior D-ring 62, the corresponding shoulder strap 36 or 38 is threaded through the first two slots, and then through a retention slot (not shown) formed in the anterior D-ring 62. The shoulder strap 36 or 38 is then threaded through the remaining two slots in the patch 64, thereby capturing the anterior D-ring 62. The patch 64 is then sewn in place on the shoulder strap 36 or 38 to secure the anterior D-ring 62 in position. Each anterior D-ring 62 includes a central aperture 66 for connection to the elastomeric cord assembly 18.

Referring to FIGS. 1 through 4, the elastomeric cord assembly 18 is formed from a plurality of elongate elastomeric cords 68. Each elastomeric cord 68 has an internal elastomeric core that may be repeatedly and resiliently deformed without degradation. Synthetic or natural rubbers may be utilized for the elastomeric core. The elastomeric core is covered by a woven fiber tube that strengthens, protects, and limits the maximum elongation of the internal elastomeric core.

Figure 4:
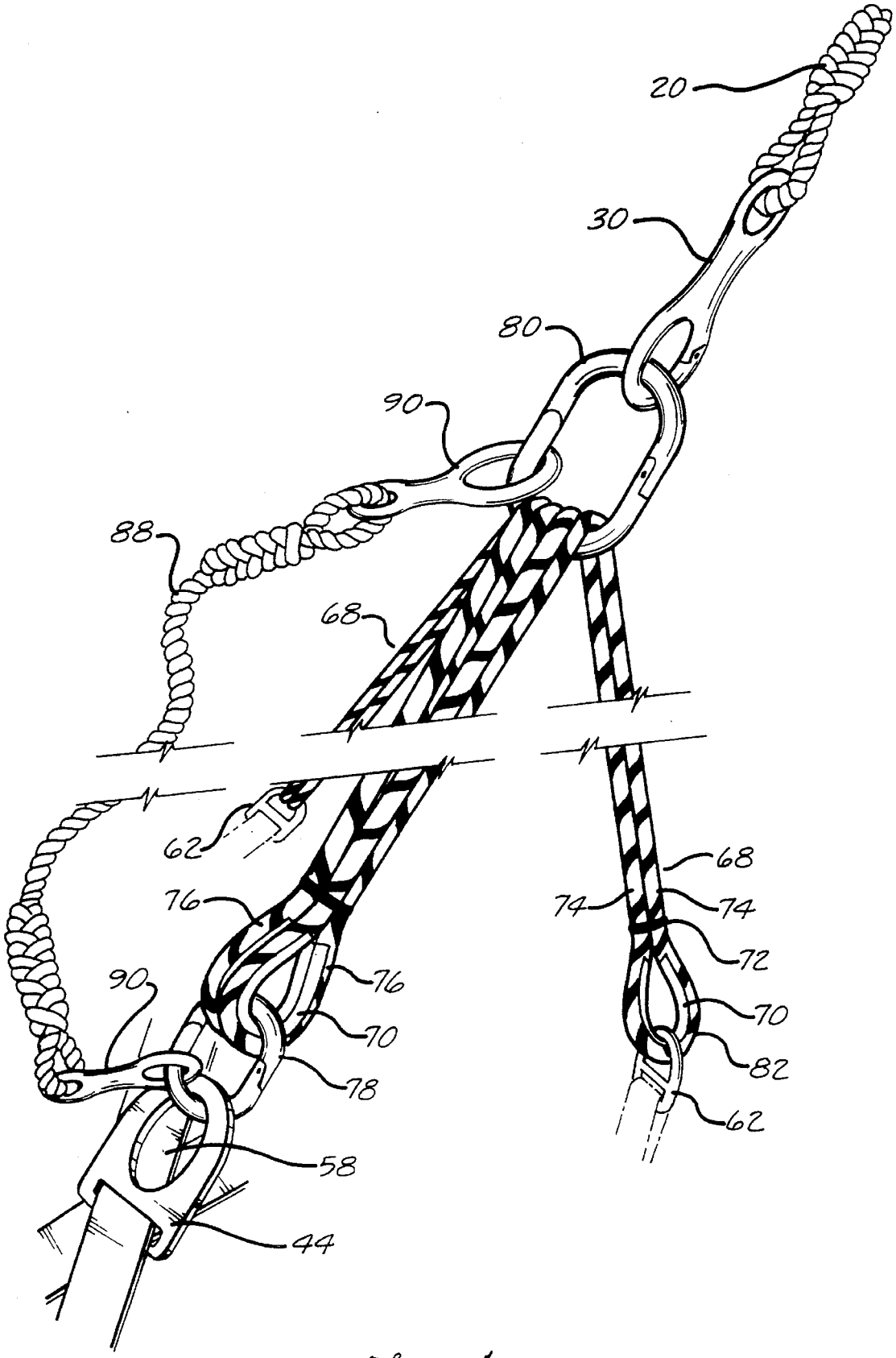
FIG. 4 provides a detail of a preferred coupling of the elastomeric cord assembly to the safety lanyard and harness of FIG. 1.

In the illustrated preferred embodiment of the safety harness assembly 10, two elastomeric cords 68 are utilized. Each elastomeric cord 68 is joined to itself endwise to form a loop. The joint in the loop is spliced using one or more "hog ring" crimped metal connections (not shown). Preferably, multiple crimped connectors are utilized, and most preferably up to four crimped connectors are used. The looped cord 68 is folded on itself to form a doubled elastomeric cord 68. A metal eyelet 70 is installed over the elastomeric cord 68 within the fold at each end of the doubled elastomeric cord 68, as shown in FIG. 4. The doubled elastomeric cord 68 is then bound at a point 72 adjacent the eyelet 70. It should be apparent to those of skill in the art that a larger diameter, a single cord could alternately be used in place of each doubled elastomeric cord 68.

Each doubled elastomeric cord 68 thus has two parallel elongate sections 74, thereby doubling the strength of the elastomeric cord 68. Each elastomeric cord 68 has a posterior end 76 that is connected to the posterior D-ring 44. The posterior ends 76 of the two doubled elastomeric cords 68 thus form the posterior end portion 26 of the elastomeric cord assembly 18. In the embodiment of the safety harness assembly 10 shown in FIGS. 1 through 3, each of the cords 68 is connected directly to the posterior D-ring 44, with the metal eyelet 70 and a portion of the cord 68 received therein being engaged with the central aperture 58 of the posterior D-ring 44. The doubled elastomeric cords 68 then pass through the clip-end of the lanyard snap hook 30.

However, in a more preferred alternative shown in FIG. 4, an oval hinged junction ring 78 is utilized to connect the posterior end 76 of the cords 68 to the posterior D-ring 44. Each doubled cord 68 then extends upwardly and passes through a lanyard junction ring 80. The lanyard junction ring 80 is also hinged and can be selectively opened or closed. The lanyard snap hook 30 on the first end 20 of the safety lanyard 22 is also connected to the lanyard junction ring 80. The safety lanyard 22 is thereby connected to the bundled elastomeric cords 68, but is free to slide along the length of the bundled elastomeric cords 68 to balance the weight of a person supported by the safety lanyard 22.

Referring to FIGS. 1 through 4, after passing through the lanyard junction ring 80 (FIG. 4) or lanyard snap hook (FIGS. 1 through 3), the doubled elastomeric cords 68 extend downwardly to the anterior D-rings 62 on the anterior side 14 of the harness 12. The two doubled elastomeric cords 68 branch out at this point, with an anterior end 82 of each cord 68 being connected to a corresponding one of the anterior D-rings 62. This connection can be made by directly connecting the anterior end 82 of the cord 68 to the corresponding anterior D-ring 62, as shown in FIGS. 1 through 4. Alternately, a junction ring (not shown) could instead be utilized.

Thus, as shown in FIGS. 1 through 3, the posterior end 26 of the elastomeric cord assembly 18, comprised of the posterior ends 76 of the two doubled elastomeric cords 68, is connected to the anterior D-ring 44. The entire elastomeric cord assembly 18 then passes upwardly through the connection point to the safety lanyard 22 (i.e., the lanyard junction ring 80 or lanyard snap hook 30). The elastomeric cord assembly 18 then splits into a left portion comprised of one of the doubled cords 68, the anterior end 82 of which is connected to the anterior D-ring 62 on the left shoulder strap 36. The other doubled cord 68 forms a fight portion of the elastomeric cord assembly 18, and is connected to the other anterior D-ring 62 secured to the right shoulder strap 38. The elastomeric cord assembly 18 is thus connected to the harness 12 at three points, proximate the central back and the front side of each shoulder of a person wearing the harness 12.

FIGS. 1 and 5 illustrate the disposition of the harness 12 when the harness and a person (not shown) wearing the harness is suspended from the lanyard 22. The elastomeric cord assembly 18 is drawn taut between the first end 20 of the safety lanyard 22 and the harness 12. The second end 84 of the safety lanyard 22 is connected by a second snap hook 86 to a fixed, rigid structure, such as the building or scaffolding on which the wearer is working (not shown).

Because the anterior D-rings 62 are secured to the anterior side 14 of the harness 12, while the posterior D-ring 44 is secured to the posterior side 16 of the harness 12, the wearer is held with the torso and head in an upright, substantially vertical position when the person's weight is supported by the harness 12 and lanyard 22. Because the anterior D-rings 62 are secured proximate the shoulder portions 50 of the shoulder straps 36 and 38, thus being positioned close to a persons head at an elevation above the posterior D-ring 44, the point of connection to the safety lanyard 22 is offset rearwardly. This provides clearance for the wearer's head between the anterior ends 82 of the doubled elastomeric cords 68.

The lanyard 22 is not directly connected to the harness 12, instead being indirectly connected through the elastomeric cord assembly 18. When a wearer of the harness falls, slack in the safety lanyard 22 is taken up until the safety lanyard 22 is drawn taut. At that point, the elastomeric cord assembly 18 begins to stretch, i.e., reversibly deform. As the doubled elastomeric cords 68 in the elastomeric cord assembly 18 elongate, the shock associated with gradual deceleration of the wearer is absorbed by the doubled elastomeric cords 68.

The resistance provided by elongation of the doubled elastomeric cords 68 in the elastomeric cord assembly 18 increases proportionately to the amount of elongation, gradually decelerating the wearer at an increasing rate. The amount of elongation of the doubled elastomeric cords 68 is determined by the weight of the wearer and the vertical distance of the fall. Elongation of the doubled elastomeric cords 68 is limited by the increasing resistance to elongation with deformation, and to a lesser extent (in extreme cases) by the external woven covers of the doubled elastomeric cords 68. The wearer's fall is thus gradually decelerated and the shock of the impact is absorbed, isolating the wearer from the shock and impact that would otherwise be transmitted to his or her body.

After deceleration is complete, the cords 68 in the elastomeric cord assembly 18 retract back to their original non-deformed state, except for that degree of deformation imposed by the resting weight of the wearer. Throughout the deceleration and while the wearer hangs from the lanyard 22 after deceleration, the wearer is maintained in an upright position, preventing the wearer's head from being tired extremely forwardly and thus reducing the chance of head or spinal cord trauma through impact with a building or other structure.

A further aspect of the present invention is shown in FIGS. 1 and 3. The safety harness assembly 10 preferably includes a fail-safe lanyard 88 connected between the safety lanyard 22 and the harness 12. In the embodiments shown in FIGS. 1 and 3, a lower end of the fail-safe lanyard 88 is connected to the posterior D-ring 44 on the posterior side of the harness 12, while the upper end of the fail-safe lanyard 88 is connected to the lanyard snap hook 30. The length of the fail-safe lanyard 88 is longer than the length of the posterior end portion 26 of the elastomeric cord assembly 18, i.e., that portion of the elastomeric cord assembly 18 extending between the posterior D-ring 44 and the lanyard snap hook 30. The fail-safe lanyard 88 is sufficiently long that it is slack both when the elastomeric cord assembly 18 is in the non-stretched, relaxed configuration, i.e., when the harness 12 is not supporting the wearer's weight, and when the elastomeric cord assembly 18 is in the fully stretched and elongated configuration, i.e., during breaking of the fall of a person wearing a safety harness assembly 10. The fail-safe lanyard 88 is thus normally bypassed and does not support the weight of the wearer. Preferably, the fail-safe lanyard 88 should be sized to be approximately one-and-one-half to two inches of slack length when the elastomeric cord assembly 18 is fully stretched and extended.

The purpose of the fail-safe lanyard 88 is to act as a backup in case of failure of the elastomeric cord assembly 18 or any of the couplings connecting the elastomeric cord assembly 18 to the harness 12. While such failure is unlikely, it provides an extra degree of safety, in anticipation of situations where wear or accidental cutting of the doubled elastomeric cords 68 may occur.

FIG. 5 shows a slightly alternate installation of the fail-safe lanyard 88. The upper end of the fail-safe lanyard 88 is spliced into the main safety lanyard 22, rather than being connected to the snap hook 30.

In a further alternative, shown in FIG. 4, the ends of the fail-safe lanyard 88 can be connected to snap hooks 90 that are in turn connected to the posterior junction ring 78 coupled to the posterior D-ring 44 and the lanyard junction ring 80.

While the harness 12 shown in FIGS. 1 through 4 is well suited for practice of the present invention, alternate harness assembly constructions are possible. For example, rather than utilizing a waist belt 32, a strap encircling the wearer's chest (not shown) could be utilized. Likewise, rather than including a complete harness, a less complete construction such as simply a chest strap could be utilized, but would not offer the same degree of security and thus is not preferred over a full torso harness. Full torso harnesses such as the harness 12 shown in FIGS. 1–4 or alternate full torso constructions prevent the wearer from slipping out from the top, bottom, or sides of the harness assembly.

Figure 6:
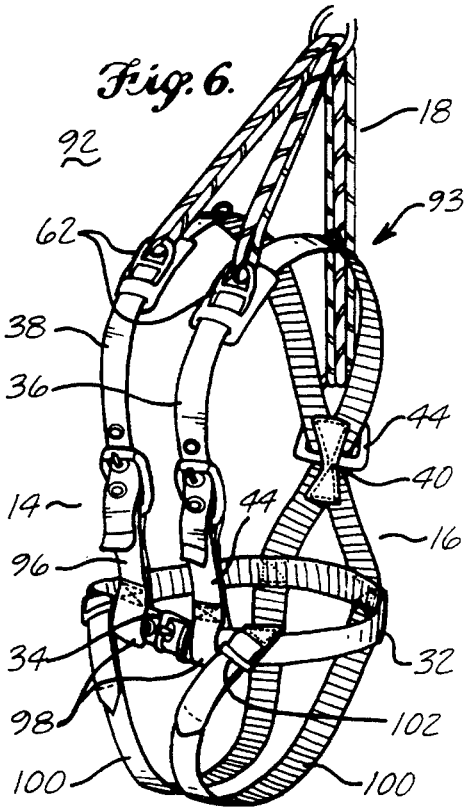
FIGS. 6, 7 and 8 present pictorial isometric, front, and back elevation views of an alternate embodiment of the safety harness of the present invention, wherein the safety harness is also capable of functioning as a tool belt.
Figure 7:
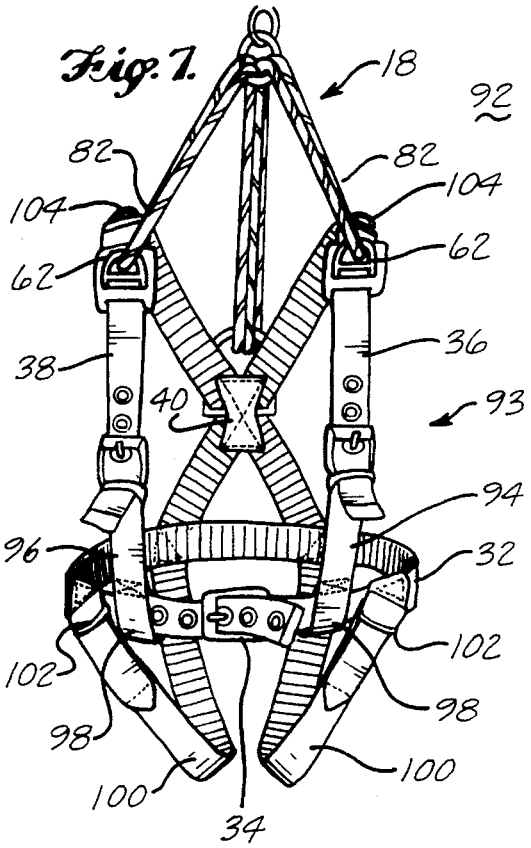
Figure 8:
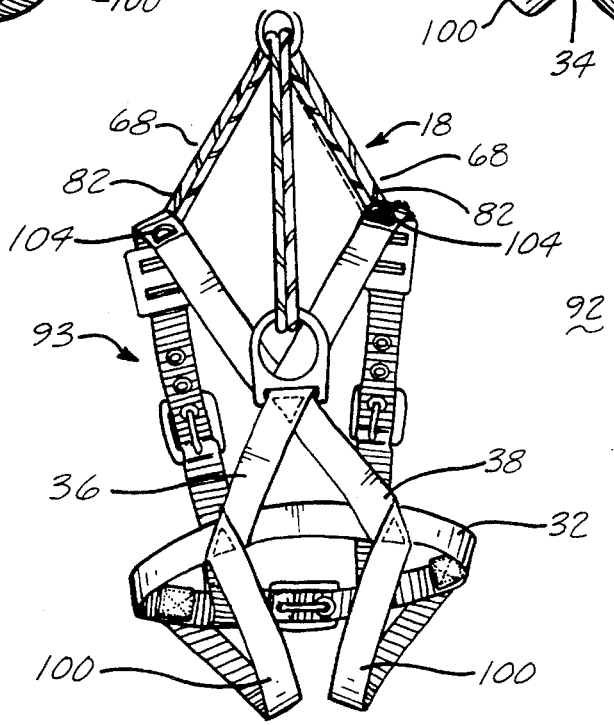

One example of a suitable alternate construction for a harness assembly is the safety harness assembly 92 shown in FIGS. 6 through 8. The harness assembly 92 is in most respects similar to the safety harness assembly 10 previously described and shown in FIGS. 1 through 4. Those features which are common are identified with same part number, and are not described in detail to avoid redundancy. Thus, the safety harness 92 includes an elastomeric cord assembly 18 connected to the posterior junction 40 of left and right shoulder straps 36 and 38 of a harness 93. The harness 93 also includes a belt 32 hat is secured to the left and right shoulder straps 36 and 38 below the posterior junction 40.

Each of the left and right shoulder straps 36 and 38 on the anterior side 14 of the harness assembly 93 is buckled to a corresponding left or fight extension strap 94 or 96, respectively. The lower ends of the extension straps 94 and 96 are not rigidly sewn or otherwise secured to the ends of the belt 32. Instead, the end of each extension strap 94 or 96 is folded upon itself and sewn to form a loop 98 through which the corresponding end of the belt 32 is threaded. This construction allows the ends of the belt 32 to be unthreaded from the loops 98, and for loops on tool holders to be threaded thereon. This enables the belt 32 to function not only as a portion of the harness 93 but also as a tool belt. Tools, window washing gear, climbing gear, or other articles can thus be hung from the belt 32.

The harness 93 is completed by forming the lower most end portions of each of the shoulder straps 36 and 38 into leg straps 100. Below the posterior junction 40, each of the shoulder straps 36 and 38 crosses over the outside of the posterior side of the belt 32, and is folded upon itself and sewn in place, as shown in FIG. 8. This causes each of the leg straps 100 to angle inwardly towards the center of the harness 93.

Referring to FIGS. 6 and 7, a double D-ring set 102 is secured to each end of the belt 32 at a location spaced away from the anterior buckle 34. These double D-ring sets 102 are sufficiently small that they do not interfere with the placement of tools on the belt 32. After the tools have been installed and the harness is positioned on the wearer, each leg strap 100 is passed between the wearer's legs and is threaded through the double D-ring set 102 to be releasably but securely fastened to anterior side of the belt 32. Once so installed, the wearer is prevented from slipping downwardly out of the harness 93.

The safety harness assembly 92 shown in FIGS. 6 through 8 also illustrates an additional aspect of the present invention. The safety harness assembly 93 includes an anterior D-ring 62 positioned and attached to each of the shoulder straps 36 and 38, as previously described for the safety harness assembly 10. However, a second pair of upper D-rings 104 is provided on the shoulder straps 36 and 38. One upper D-ring 104 is secured to the shoulder portion 50 of the corresponding shoulder strap 36 or 38, spaced away from the corresponding anterior D-ring 62 in the direction above and toward the posterior side 16 of the harness 93.

In order to adjust the disposition of a person being supported by the harness assembly 93, the connection of the elastomeric cord assembly 18 to the harness assembly 93 can be changed to utilize the upper D-rings 104. Prior to putting on the harness assembly 93, each anterior end 82 of a doubled elastomeric cord 68 of the elastomeric cord assembly 18 is detached from the corresponding anterior D-ring 62. The anterior end 82 of the doubled elastomeric cord is then threaded through the corresponding upper D-ring 104, and is reattached to the corresponding anterior D-ring 62, as shown in phantom in FIG. 4. The anterior end 82 of each doubled elastomeric cord 68 thus lies along and follows the path of the corresponding shoulder portion 50 of the shoulder strap 36 or 38 between the upper D-ring 104 and the anterior D-ring 62.

This threaded connection effectively moves the point of connection of the anterior end portion 24 of the elastomeric cord 18 to the harness 93 rearwardly and toward the center of weight of the wearer. This alternate attachment may be desired when the wearer is carrying many heavy tools on the tool belt 32, to balance the load and tilt the wearer slightly forwardly from the vertical position. The wearer is thus supported in an upright and slightly forwardly inclined positioned when the wearer's weight is supported by the safety harness assembly 92 and the lanyard 22.

While the preferred embodiments of safety harnesses 10 and 92 described above utilize an elastomeric cord assembly 18, it should be readily apparent to those of ordinary skill in the art that other resilient members can be employed. For example, a molded "Y"-shaped elastomeric member (not shown) could be substituted. Further, while a three-point connection for the resilient member is preferred for stability, such as is provided by the elastomeric cord assembly 18, a single point connection of a resilient member between the safety lanyard and posterior of the harness, or a two-point connection from the safety lanyard to the left and right sides of the shoulder portions or posterior of the harness, could be employed. Such alternatives would still provide effective shock absorption, but are not as preferred due to the lack of stability relative to the three-part connection.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A safety harness for suspending a person wearing the harness from a single safety lanyard, comprising:

a harness securable to a person's torso and having an anterior side and a posterior side and defining left and right sides;

a resilient harness support assembly having at least three end branches, a first end branch being connected to the harness proximate the left anterior side of the harness, a second end branch being connected to the harness proximate the right anterior side of the harness, and a third end branch being connected to the posterior side of the harness, the harness support assembly further having an intermediate portion disposed between the third end branch and the first and second end branches, at least a portion of the resilient harness support assembly being constructed from a resilient material;

a lanyard coupling coupled to the intermediate portion of the resilient harness support assembly and disposed centrally relative to the left and right sides of the harness for connection to the single safety lanyard whereby the harness and the single safety lanyard support the person's weight and position the person in a vertically and laterally upright disposition when the person is suspended from the single safety lanyard, the resilient harness support assembly being reversibly deformable to absorb impact loads imposed on the safety lanyard and the harness and a fail-safe lanyard connected at a first end to the harness and at a second end to the safety lanyard.

2. The safety harness of claim 1, wherein the resilient harness support assembly comprises an elastomeric cord.

3. The safety harness of claim 1, wherein the harness comprises:

left and right shoulder straps configured to extend from the anterior side of a person's torso, over the shoulders and to the posterior side of a person's torso when the harness is worn; and a belt for encircling the person's torso when worn, the belt being connected to each of the left and right shoulder straps on both the anterior side and posterior side of the harness.

4. The safety harness of claim 3, wherein the left and right shoulder straps extend below the belt and are connected to left and right leg cuffs for encircling a person's thighs when worn.

5. The safety harness of claim 1, wherein the first and second end branches of the resilient harness support assembly are connected to the anterior side of the harness at a point that is nearer to a person's head when worn than is a point at which the third and branch is connected to the posterior side of the harness, whereby the person is positioned in an upright disposition when the harness and lanyard support the person's weight.

6. The safety harness of claim 5, further comprising a plurality of fittings provided in spaced relationship on each of the left and right shoulder straps, the fittings being adapted to be selectively coupled to the first and second end branches, respectively, of the resilient harness support assembly to provide for selective adjustment of the upright inclination of a person wearing the harness between a vertical disposition and disposition inclined forwardly from vertical when the person's weight is supported by the harness and safety lanyard.

7. The safety harness of claim 5, further comprising left and fight fittings provided on the left and right shoulder straps and adapted to be connected to the first and second end branches, respectively, of the resilient harness support assembly, the left and right fittings being positioned on the left and right shoulder straps so as to be proximate a person's head when the harness is worn, whereby a user is positioned in an upright and forwardly inclined positioned when the user's weight is supported by the safety lanyard and harness.

8. The safety harness of claim 1, wherein the resilient harness support assembly comprises an elastomeric cord assembly, the elastomeric cord assembly comprising a bundle of elongate elastomeric cords, each elastomeric cord having a second end attached to the posterior side of the harness, a left group of the elastomeric cords having a first end connected to the left shoulder strap on the anterior side of the harness and a right group of the elastomeric cords having a first end connected to the right shoulder strap on the anterior side of the harness.

9. The safety harness of claim 3, wherein the belt comprises a tool belt capable of supporting the weight of a plurality of tools, wherein the anterior side of each of the left and right shoulder straps defines a loop through which the belt may be threaded upon securing the harness to a person, the belt also being removable from the loops defined by the left and right shoulder straps to permit the belt to be engaged with tools.

10. The safety harness of claim 9, wherein the harness further comprises left and right leg straps, each having a first end secured to the posterior side of the belt and a second free end adapted to releasably engage with left and right fittings, respectively, provided on the anterior side of the belt, the left and right leg straps being of sufficient length to pass from the posterior side of the harness through a person's legs to be connected to the anterior side of the harness when the harness is worn.

11. The safety harness of claim 1, wherein the fail-safe lanyard has sufficient length to normally be slack when the harness and safety lanyard supports a person's weight with the resilient harness support assembly in a non-stretched configuration.

12. The safety harness of claim 11, wherein the fail-safe lanyard has sufficient length to normally remain slack when the resilient harness support assembly is stretched to a fully extended configuration.

13. A safety harness, comprising:

a harness securable to a person's torso and having an anterior side and a posterior side, the harness including:

(a) left and right shoulder straps configured to extend from the anterior side of a person's torso, over the shoulders and to the posterior side of a person's torso when the harness is worn; and (b) a belt for encircling the person's torso when worn, the belt being connected to each of the left and right shoulder straps on both the anterior side and posterior side of the harness;

an elastomeric harness support having first and second end branches connected to the left and right shoulder straps, respectively, of the harness proximate the anterior side of the harness, a third end branch connected to the posterior side of the harness, and an intermediate portion disposed between the third end branch and the first and second end branches constructed and configured to be connectable to a safety lanyard, whereby the harness and safety lanyard are capable of supporting the person's weight and act to position the person in a vertically and laterally upright disposition, the elastomeric harness support being reversibly deformable to absorb impact loads imposed on the safety lanyard and the harness, the elastomeric harness support comprising a Y-shaped elastomeric member; and a fail-safe lanyard connected at a first end to the harness and at a second end to the safety lanyard.

* * * * *

UNITED STATES PATENT AND TRADEMARK OFFICE

CERTIFICATE OF CORRECTION

PATENT NO. : 5,487,444
DATED : January 30, 1996
INVENTOR(S) : M. Dennington

It is certified that error appears in the above-indentified patent and that said Letters Patent is hereby corrected as shown below:

| COLUMN | LINE | |
|---|---|---|
| 3 | 34 | "fight" should read --right-- |
| 5 | 11 | "fight" should read --right-- |
| 6 | 2 | "tired" should read --tilted-- |
| 7 | 6 | "fight" should read --right-- |
| 9 (Claim 5, line 5) | 11 | "and" should read --end-- |
| 9 (Claim 7, line 2) | 26 | "fight" should read --right-_ |

Signed and Sealed this

Seventh Day of May, 1996

Bruce Lehman

*Attest:*

BRUCE LEHMAN

*Attesting Officer*

*Commissioner of Patents and Trademarks*